United States Patent [19]

Davitt et al.

[11] 4,374,686

[45] Feb. 22, 1983

[54] DELAY COMPOSITION FOR DETONATORS

[75] Inventors: Alan L. Davitt, Brownsburg; Kenneth A. Yuill, Alfred, both of Canada

[73] Assignee: CXA Ltd./CXA Ltee, North York, Canada

[21] Appl. No.: 242,531

[22] Filed: Mar. 11, 1981

[30] Foreign Application Priority Data

Oct. 10, 1980 [CA] Canada ..... 362160

[51] Int. Cl.[3] ..... C06B 45/02

[52] U.S. Cl. ..... 149/21; 149/37

[58] Field of Search ..... 149/21, 37

[56] References Cited

U.S. PATENT DOCUMENTS

| | | | |
|---|---|---|---|
| 1,877,127 | 9/1932 | Hale | 149/37 |
| 1,903,814 | 4/1933 | Graff | 149/37 |
| 2,560,452 | 7/1951 | Kerr et al. | 149/37 |
| 3,020,610 | 2/1962 | Rejdak | 149/37 |
| 3,089,798 | 5/1963 | Rejdak | 149/37 |

*Primary Examiner*—Stephen J. Lechert, Jr.

[57] ABSTRACT

A novel pyrotechnic delay composition is provided for use in both non-electric and electric blasting caps which is characterized by uniform burn rate and low toxicity. The composition, comprising an admixture of stannic oxide and silicon, has no carcinogenic properties.

5 Claims, 2 Drawing Figures

DELAY COMPOSITION FOR DETONATORS

Figure 1:
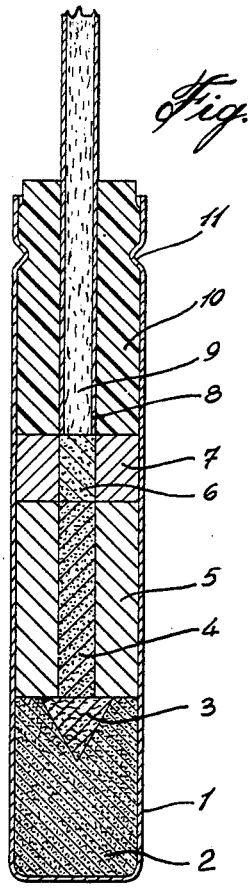

This invention relates to a novel pyrotechnic delay composition characterized by low toxicity and highly uniform burn rate. In particular, the invention relates to a delay composition for use in both non-electric and electric blasting caps whereby the millisecond delay times achieved have a very narrow distribution or scatter.

Delay detonators, both non-electric and electric, are widely employed in mining, quarrying and other blasting operations in order to permit sequential initiation of the explosive charges in a pattern of boreholes. Such a technique, commonly referred to as a millisecond delay blasting operation, is effective in controlling the fragmentation of the rock being blasted and, in addition, provides a reduction in ground vibration and in air blast noise.

Modern commercial delay detonators, whether non-electric or electric, comprise a metallic shell closed at one end which shell contains in sequence from the closed end a base charge of a detonating high explosive, such as for example, PETN and an above adjacent, primer charge of a heat-sensitive detonable material, such as for example, lead azide. Adjacent the heat-sensitive material is an amount of a deflagrating or burning composition of sufficient quantity to provide a desired delay time in the manner of a fuse. Above the delay composition is an ignition charge adapted to be ignited by an electrically heated bridge wire or, alternatively, by the heat and flame of a low energy detonating cord or shock wave conductor retained in the open end of the metallic shell.

A large number of burning delay compositions comprising mixtures of fuels and oxidizers are known in the art. Many are substantially gasless compositions. That is, they burn without evolving large amounts of gaseous by-products which would interfere with the functioning of the delay detonator. In addition to an essential gasless requirement, delay compositions are also required to be safe to handle, from both an explosive and health viewpoint, they must not deteriorate over periods of storage and hence change in burning characteristics, they must be simply compounded and economical to manufacture and they must be adaptable for use in a wide range of delay units within the limitations of space available inside a standard detonator shell. The numerous delay compositions of the prior art have met with varying degrees of success in use and application. For example, an oxidizer commonly employed, barium chromate, is recognized as carcinogenic and hence special precautions are required in its use. Other compositions have very high burn rates and hence are difficult to incorporate in delay detonators having short delay periods. As a result, variations in delay times occur within groups of detonators intended to be equal. Similar difficulties are experienced with compositions having slow burn rates.

It has now been found that most if not all the disadvantages of known or prior art pyrotechnic delay compositions can be overcome by providing a burning composition from 55 to 80% by weight of stannic oxide and from 20 to 45% by weight of silicon.

The invention may be more clearly understood by reference to the accompanying drawing which illustrates in:

FIG. 1 a non-electric delay detonator and in

Figure 2:
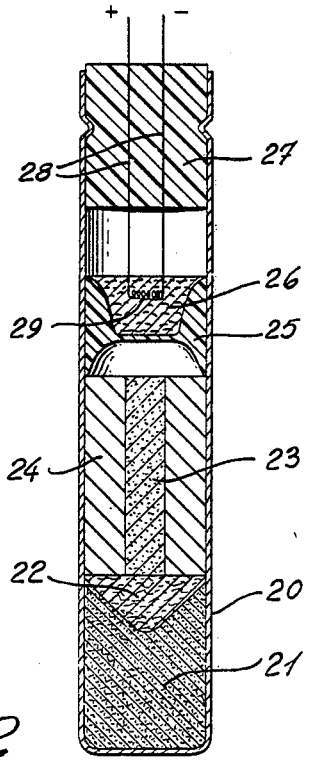

FIG. 2, an electric delay detonator, showing the position therein of the delay composition of the invention.

With reference to FIG. 1, 1 designates a metal tubular shell closed at its bottom end and having a base charge of explosive 2 pressed or cast therein. 3 represents a primer charge of heat-sensitive explosive. The delay charge or composition of the invention is shown at 4 contained in drawn lead tube or carrier 5. Surmounting delay charge 4 is ignition charge 6 contained in carrier 7. Above ignition charge 6 is the end of a length of inserted low energy detonating cord 8 containing explosive core 9. Detonating cord 8 is held centrally and securely in tube 1 by means of closure plug 10 and crimp 11. When detonating cord 8 is set off at its remote end (not shown) heat and flame ignites ignition charge 6, in turn, igniting delay composition 4. Composition 4 burns down to detonate primer 3 and base charge 2.

With reference to FIG. 2, a tubular metal shell 20 closed at its bottom end is shown containing a base charge of explosive 21. A primer charge 22 is indented into the upper surface of charge 21. Above charge 21 and primer 22 and in contact therewith is delay composition 23 contained within a swaged and drawn lead tube or carrier 24. Spaced above delay charge 23 is a plastic cup 25 containing an ignition material charge 26, for example, a red lead/boron mixture. The upper end of shell 20 is closed by means of plug 27 through which pass lead wires 28 joined at their lower ends by resistance wire 29 which is embedded in ignition charge 26. When current is applied to wire 29 through leads 28, charge 26 is ignited. Flame from ignited charge 26 ignites delay composition 23 which in turn sets off primer 22 and explosive 21.

The invention is illustrated with reference to several series of tests summarized in the following Examples and Tables in which all parts and percentages are by weight.

EXAMPLES 1-6

A number of delay compositions were made by intimately mixing together different proportions of stannic oxide and powdered silicon. The specific surface area of stannic oxide was 1.76 $m^2/g$ while the specific surface area of silicon was 8.40 $m^2/g$. The mixtures were prepared by vigorous mechanical stirring of the ingredients in slurry form utilizing water as the liquid vehicle. After mixing, the slurry was filtered under vacuum and the resulting filter cake was dried and sieved to yield a reasonably free-flowing powder. Delay elements were made by loading lead tubes with these compositions, drawing these tubes through a series of dies to a final diameter of about 6.5 mm and cutting the resultant rod into elements of length 25.4 mm. The delay times of these elements, when assembled into nonelectric detonators initiated by Nonel (Reg. TM) shock wave conductor were measured. Delay time data are given in Table I below while the sensitivities of these compositions to friction, impact and electrostatic discharge are shown in Table II below.

TABLE I

| Example | Composition Proportion of Stannic Oxide: Silicon | Length of Delay Element (mm) | Number of Detonators Fired | Delay time[1] (milliseconds) Mean | Min. | Max. | Scatter | Coefficient of Variation[2] (%) |
|---|---|---|---|---|---|---|---|---|
| 1 | 80:20 | 25.4 | 20 | 1101 | 1091 | 1119 | 28 | 0.68 |
| 2 | 75:25 | 25.4 | 20 | 862 | 848 | 873 | 25 | 0.65 |
| 3 | 70:30 | 25.4 | 20 | 767 | 759 | 796 | 37 | 1.29 |
| 4 | 65:35 | 25.4 | 20 | 835 | 825 | 849 | 24 | 0.88 |
| 5 | 60:40 | 25.4 | 20 | 1522 | 1469 | 1546 | 77 | 1.38 |
| 6 | 55:45 | 25.4 | 20 | 1998 | 1934 | 2096 | 162 | 2.27 |

[1]Each detonator incorporated a 12.7 mm long red lead-silicon igniter element. Delay times shown include the delay time contribution of igniter element, nominally 60–70 milliseconds.
[2]Delay time coefficient of variation is delay time standard deviation expressed as a percentage of mean delay time.

TABLE II

| Composition Proportion of Stannic Oxide: Silicon | Impact[1] Min. Ignition Height (cm) | Friction[2] Min. Ignition Height (cm) | Electrostatic Discharge[3] Min. Ignition Energy (mJ) |
|---|---|---|---|
| 80:20 | >139.7 | >83.8 | 72.9 |
| 75:25 | >139.7 | >83.8 | 10.3 |
| 70:30 | >139.7 | >83.8 | 28.5 |
| 65:35 | >139.7 | >83.8 | 114.0 |
| 60:40 | >139.7 | >83.8 | 137.9 |

Notes:
[1]In impact test, mass of fall-hammer (steel) 5.0 kg. Samples tested in copper/zinc (90/10) cup.
[2]In friction test, mass of torpedo (with aluminum head) 2.898 kg. Samples tested on aluminum blocks.
[3]Discharge from 570 pF capacitor.

EXAMPLES 7–8

The relationships between mean delay time and length of delay element were established for two of the compositions described in Examples 1–6, namely mixtures with oxidizer-fuel proportions of 75:25 and 65:35. Again, these compositions were tested in non-electric detonators initiated by Nonel. Results are shown in Table III below.

TABLE III

| Example | Composition Proportion of Stannic Oxide: Silicon | Length (L) of Delay Element (mm) | Number of Detonators Fired | Delay time* (milliseconds) Mean | Min. | Max. | Scatter | Coeff. of Variation (%) | Relation between Mean Delay Time (T) and Delay Element Length (L) |
|---|---|---|---|---|---|---|---|---|---|
| 7 | 75:25 | 6.35 | 20 | 266 | 259 | 275 | 16 | 1.70 | $\overline{T}$(ms) = 31.4 L + 61.0 ms (correlation coeff. 0.9997) |
| | | 12.7 | 20 | 452 | 444 | 460 | 16 | 0.91 | |
| | | 25.4 | 20 | 862 | 848 | 873 | 25 | 0.65 | |
| 8 | 65:35 | 6.35 | 20 | 265 | 245 | 272 | 27 | 2.52 | $\overline{T}$(ms) = 30.0 L + 71.5 ms (correlation coeff. 0.9999) |
| | | 12.7 | 10 | 448 | 436 | 459 | 23 | 1.62 | |
| | | 25.4 | 20 | 835 | 825 | 849 | 24 | 0.88 | |

*Each detonator incorporated a 12.7 mm long red lead-silicon igniter element. Delay times quoted above include delay time contribution of igniter element, nominally 60–70 milliseconds.

From the results shown in Table III, it can be seen that strong linear relationships exist between mean delay time and length of stannic oxide–silicon delay element. This characteristic is important in manufacturing processes which utilize drawn lead delay elements, as it affords control of nominal delay times by simple manipulation of element cutting lengths.

EXAMPLES 9–10

The delay time characteristics of the stannic oxide-silicon pyrotechnic compositions of Examples 7 and 8 when subjected to a low temperature condition were examined. A number of non-electric, Nonel initiated detonators, each with a delay train consisting of a 12.7 mm long red lead-silicon igniter element and 12.7 mm long stannic oxide-silicon delay element were tested at temperatures of 20° C. and −40° C. Timing results are shown in Table IV below.

TABLE IV

| Example | Composition Proportion of Stannic Oxide: Silicon | Test Temperature (°C.) | Number of Detonators Tested/Number Fired | Delay time* (milliseconds) Mean | Min. | Max. | Scatter | Coeff. of Variation (%) | % change in delay time (20° C. to −40° C.) | % change in delay time/°C. |
|---|---|---|---|---|---|---|---|---|---|---|
| 9 | 75:25 | 20 | 20/20 | 452 | 444 | 460 | 16 | 0.91 | 5.31 | 0.089 |
| | | −40 | 20/20 | 476 | 466 | 486 | 20 | 1.11 | | |
| 10 | 65:35 | 20 | 10/10 | 448 | 436 | 459 | 23 | 1.62 | 5.13 | 0.086 |

TABLE IV-continued

| Example | Composition Proportion of Stannic Oxide: Silicon | Test Temperature (°C.) | Number of Detonators Tested/Number Fired | Delay time* (milliseconds) Mean | Min. | Max. | Scatter | Coeff. of Variation (%) | % change in delay time (20° C. to −40° C.) | % change in delay time/°C. |
|---|---|---|---|---|---|---|---|---|---|---|
| | | −40 | 10/10 | 471 | 464 | 481 | 17 | 1.22 | | |

*Each detonator had a 12.7 mm long red lead-silicon igniter element and a 12.7 mm long stannic oxide-silicon delay element. Delay times quoted above include delay time contribution of igniter element, nominally 60–70 milliseconds.

From the results shown in Table IV, it is seen that the temperature coefficients of the 75:25 and 65:35 stannic oxide-silicon compositions over the temperature range −40° C. to +20° C. are 0.089 percent per degree C. and 0.086 percent per degree C. respectively.

EXAMPLE 11

The timing performance and functioning reliability, at both normal and low temperatures, of stannic oxide-silicon 70:30 composition in non-electric detonators initiated by low energy detonating cord were established. As in the previous Examples, stannic oxide of specific surface area 1.76 $m^2/g$ and silicon of specific surface area 8.40 $m^2/g$ were employed.

100 non-electric detonators were tested at normal temperature (20° C.). Additionally, 72 detonators were subjected to a temperature of −40° C. for 24 hours, subsequently fired at that temperature and their delay times noted. The results are shown in Table V, below.

TABLE V

| Composition Proportion of Stannic Oxide: Silicon | Length of Delay Element (mm) | Test Temp. (°C.) | Number of Detonators Tested/Number Fired | Delay Time* (milliseconds) Mean | Min. | Max. | Scatter | Coefficient of Variation (%) |
|---|---|---|---|---|---|---|---|---|
| 70:30 | 25.4 | 20 | 100/100 | 728 | 705 | 747 | 42 | 1.15 |
| | 25.4 | −40 | 72/72 | 770 | 739 | 786 | 47 | 1.23 |

*Each detonator had a 12.7 mm long red lead-silicon igniter element. Delay times quoted above include delay time contribution of igniter element, nominally 60–70 milliseconds.

It was possible to conclude from the results shown in Table V that the functioning reliability of $SnO_2$-Si 70:30 composition in non-electric detonators at a temperature of 20° C. is 0.97 at a confidence level of 95 percent. At a temperature of −40° C., the functioning reliability of the same composition is 0.95 at a confidence level of 97.5 percent.

EXAMPLE 12

In order to assess the effect of the specific surface area of silicon on the delay time characteristics of stannic oxide-silicon composition, three mixtures, each consisting of $SnO_2$-Si in the mass ratio 70:30, were prepared. Silicon samples of specific surface area 8.40, 3.71 and 1.81 $m^2/g$ were used in the preparation of these mixtures. The delay times of these compositions were measured in assembled Nonel initiated non-electric detonators. A summary of the results is shown in Table VI, below.

TABLE VI

| Composition Proportion of Stannic Oxide: Silicon | Specific Surface Area of Silicon ($m^2/g$) | Length of Delay Element (mm) | Number of Detonators Fired | Delay time (milliseconds) Mean | Min. | Max. | Scatter | Coefficient of Variation (%) |
|---|---|---|---|---|---|---|---|---|
| 70:30 | 8.40 | 25.4 | 20 | 767[1] | 759 | 796 | 37 | 1.29 |
| 70:30 | 3.71 | 25.4 | 20 | 1578[2] | 1527 | 1619 | 92 | 1.48 |
| 70:30 | 1.81 | 25.4 | 20 | 3142[3] | 3070 | 3181 | 111 | 1.07 |

Notes:
[1], [2]Each detonator incorporated a 12.7 mm long red lead-silicon igniter element. Delay times quoted include delay time contribution of this igniter element, nominally 60–70 milliseconds.
[3]Each detonator incorporated a 12.7 mm long red lead-silicon igniter element and a 6.35 mm long stannic oxide (1.76 $m^2/g$) - silicon (8.40 $m^2/g$) 75:25 igniter element. Delay times quoted include delay time contribution of these two igniter elements, nominally 260–270 milliseconds.

As seen from the Table VI results as the fuel specific surface area is decreased the greater is the delay time of the composition.

EXAMPLES 13–15

The suitability of some of the above compositions for use in electric detonators was determined. Oxidant-fuel combinations which were evaluated were 80:20, 75:25 and 65:35 $SnO_2$-Si by mass. Stannic oxide of specific surface area 1.76 $m^2/g$ and silicon of specific surface area 8.40 $m^2/g$ were employed. Electric detonators, each having a delay train consisting of a 6.35 mm long red lead-silicon igniter element and a 25.4 mm long stannic oxide-silicon delay element, were assembled and fired. The delay time performance of these units is reported in Table VII, below.

TABLE VII

| Example | Composition Proportion of Stannic Oxide: Silicon | Length of Delay Element (mm) | Number of Detonators Fired | Delay Time (milliseconds) Mean | Min. | Max | Scatter | Coefficient of Variation (%) |
|---|---|---|---|---|---|---|---|---|
| 13 | 80:20 | 25.4 | 10 | 1047 | 1037 | 1056 | 19 | 0.70 |

TABLE VII-continued

| Example | Composition Proportion of Stannic Oxide: Silicon | Length of Delay Element (mm) | Number of Detonators Fired | Delay Time (milliseconds) Mean | Min. | Max | Scatter | Coefficient of Variation (%) |
|---|---|---|---|---|---|---|---|---|
| 14 | 75:25 | 25.4 | 10 | 767 | 752 | 780 | 28 | 1.11 |
| 15 | 65:35 | 25.4 | 10 | 759 | 748 | 776 | 28 | 1.23 |

Note
Each detonator incorporated a 6.35 mm long red lead-silicon igniter element. Delay times quoted above include delay time contribution of this igniter element, nominally 25–35 milliseconds.

The stannic oxide oxidant and the silicon fuel utilized in the novel delay composition must be in a finely divided state. Measured in terms of specific surface, the stannic oxide ranges from 0.9 to 3.5 $m^2/g$, preferably 1.3 to 2.6 $m^2/g$ while the silicon ranges from 1.4 to 10.1 $m^2/g$, preferably 1.8 to 8.5 $m^2/g$. The oxidizer and fuel ingredients must essentially be intimately combined for optimum burning characteristics. For this purpose the oxidizer and fuel may advantageously be slurried with vigorous stirring in water as a carrier, the water removed by vacuum filtration and the filter cake dried and sieved to yield a free-flowing, fine powder ready for use.

The uniformity of burning times provided by the novel pyrotechnic delay composition of the invention, as illustrated by the examples under both normal temperature and low temperature conditions, can be seen to represent a significant contribution to the detonator art.

I claim:

1. A pyrotechnic delay composition adapted for non-electric and electric millisecond delay detonators comprising from 55% to 80% by weight of particulate stannic oxide and from 20% to 45% by weight of particulate silicon.

2. An improved delay blasting detonator having a delay composition interposed between an ignition element and a primer/detonation element, said delay composition comprising 55% to 80% by weight of particulate stannic oxide and from 20% to 45% of particulate silicon.

3. A delay composition as claimed in claim 1 wherein the particulate stannic oxide has a specific surface of from 0.9 to 3.5 $m^2/g$ and the particulate silicon has a specific surface of from 1.4 to 10.1 $m^2/g$.

4. A delay blasting detonator as claimed in claim 2 which is a non-electric detonator.

5. A delay blasting detonator as claimed in claim 2 which is an electric detonator.

* * * * *